US006382474B1

(12) United States Patent
Woods et al.

(10) Patent No.: US 6,382,474 B1
(45) **Date of Patent: *May 7, 2002**

(54) AEROSOL VALVE ASSEMBLY FOR SPRAYING VISCOUS MATERIALS OR MATERIALS WITH LARGE PARTICULATES

(75) Inventors: John R. Woods, Woodland Hills, CA (US); Greg Mills, Seneca, MO (US)

(73) Assignee: Spraytex, Inc., Valencia, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/656,247

(22) Filed: Sep. 5, 2000

Related U.S. Application Data

(63) Continuation-in-part of application No. 09/312,133, filed on May 14, 1999, now Pat. No. 6,112,945.

(51) Int. Cl.[7] ..... B65D 83/00

(52) U.S. Cl. ..... 222/402.25; 222/464.5

(58) Field of Search ..... 222/402.1, 402.24, 222/402.25, 464.1, 464.3, 464.5

(56) References Cited

U.S. PATENT DOCUMENTS

| | | | | | |
|---|---|---|---|---|---|
| 3,206,078 | A | * | 9/1965 | Leimegger | 222/464.1 |
| 3,806,004 | A | * | 4/1974 | Kolkovsky | 222/464.5 |
| 4,220,258 | A | * | 9/1980 | Gruenewald | 222/402.25 |
| 5,450,983 | A | * | 9/1995 | Stern et al. | 222/402.25 |
| 5,842,076 | A | * | 11/1998 | Glover et al. | 222/464.1 |
| 6,112,945 | A | * | 9/2000 | Woods | 222/1 |

* cited by examiner

*Primary Examiner*—Joseph A. Kaufman
(74) *Attorney, Agent, or Firm*—Pillsbury Winthrop LLP

(57) ABSTRACT

A valve assembly is disclosed for use in an aerosol spray can capable of spraying viscous materials or materials with large particulates without clogging or packing like traditional aerosol spray cans designed for spraying texture materials. The valve opening is located at the bottom of the assembly rather than at the top, thus allowing highly-viscous materials, such as a fire suppressant material, or materials having large particulates, such as stucco, to be sprayed from an aerosol spray can without clogging of the valves. The valve assembly can spray materials that more closely resemble the original surface texture found on textured and stucco-covered walls and ceilings of buildings and structures.

21 Claims, 12 Drawing Sheets

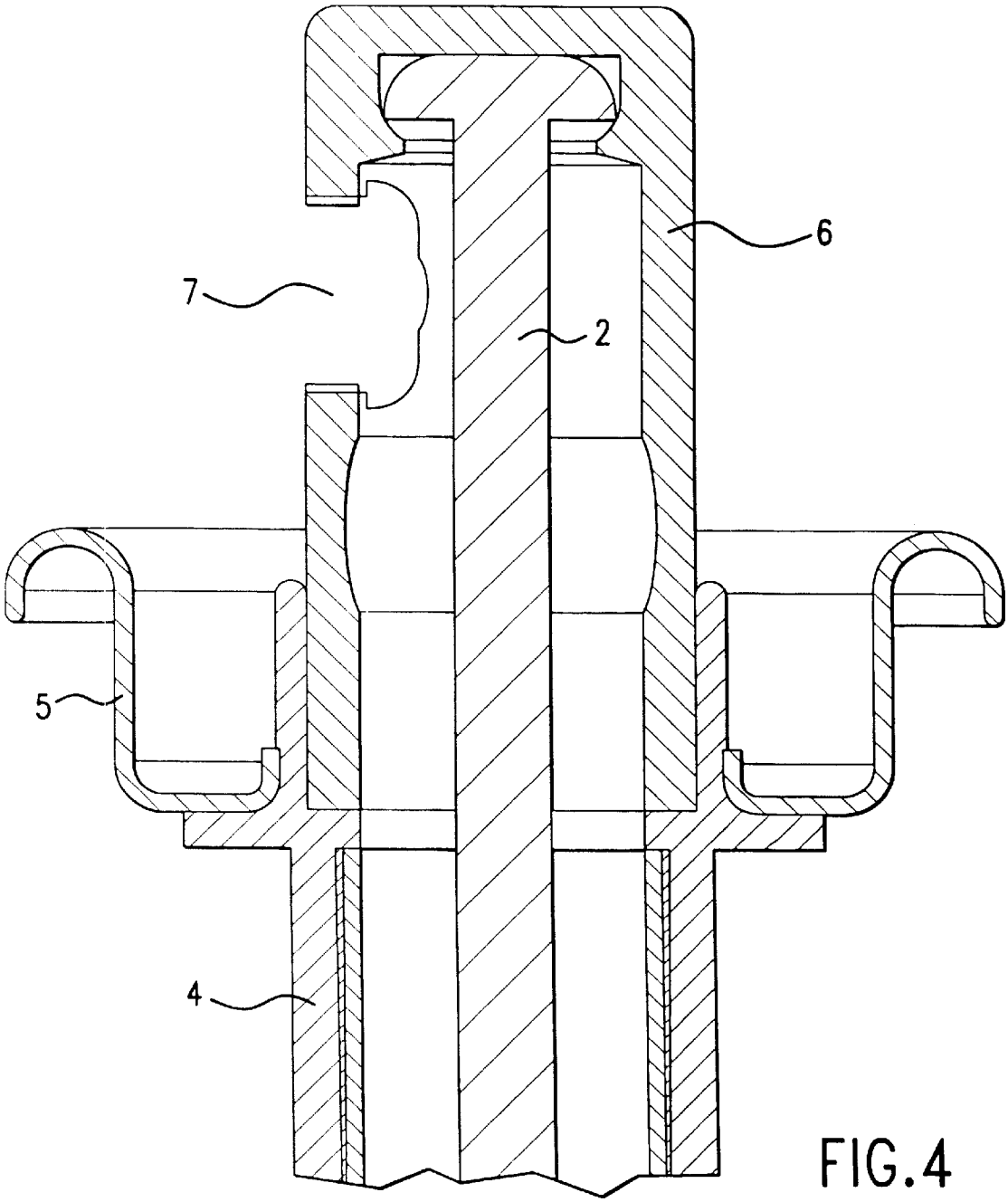
FIG.4
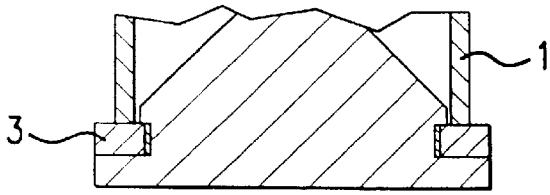

AEROSOL VALVE ASSEMBLY FOR SPRAYING VISCOUS MATERIALS OR MATERIALS WITH LARGE PARTICULATES

FIELD OF INVENTION

This application is a Continuation-in-Part of application U.S. Ser. No. 09/312,133 filed on May 14, 1999, now U.S. Pat. No. 6,112,945. This invention relates to a valve assembly for use in an aerosol spray can that is capable of spraying viscous materials or materials with large particulates without clogging or packing like traditional aerosol spray cans designed for spraying texture materials.

BACKGROUND OF THE INVENTION

The practice of dispensing heavy and particulate materials through traditional aerosol spray can valve assemblies in the aerosol industry has presented problems in which the heavy and particulate materials to be dispersed clog up the valve assemblies. These heavy and particulate materials may include exterior stucco, heavy sand finishes, drywall and acoustic ceiling patching materials, fire suppressant materials, adhesive and bonding materials, and even culinary sauces.

A traditional aerosol spray can may be filled with these heavy and particulate materials for spraying. However, because of the placement of the valve assembly in traditional aerosol spray cans, these heavy and particulate materials will clog up the valve assemblies and render the aerosol spray cans inoperative. Constant operation of these aerosol spray cans in spraying heavy and particulate materials is not possible due to the inconsistent ability of these traditional valve assemblies to dispense these materials without clogging.

U.S. Pat. No. 5,715,975, issued to Stem et al., discloses an aerosol spray texturing device that is comprised of a container, a nozzle, a valve assembly, and an outlet. The valve assembly in the '975 patent is located in the upper section of the container near the nozzle. Although the nozzle tube of the device in the '975 patent may be configured to spray texture materials, the device in the '975 patent still has the problem of clogging or packing of the valve assembly by the particulates contained in the texture material for spraying, especially if the particulates are large, like those found in stucco or other heavy and particulate materials such as those mentioned above.

U.S. Pat. No. 5,037,011, issued to the present Applicant, discloses a spray apparatus for spraying a texture material through a nozzle. Similarly, in this apparatus, there exists a problem of spraying texture materials having large particulates, such as stucco, because the particulates clog up the valve opening within the spray apparatus.

Therefore, a long-standing need has existed to provide an apparatus that may be used to readily apply viscous, heavy and particulate materials in aerosol form, such as exterior stucco, heavy sand finishes, drywall and acoustic ceiling patching materials, fire suppressant materials, adhesive and bonding materials, and culinary sauces. Furthermore, the heavy and particulate materials to be applied should be contained in a hand-held applicator so that the materials may be conveniently stored, as well as dispensed, in a simple and convenient manner without clogging or packing the valve assembly of the applicator.

SUMMARY OF THE INVENTION

An object of the present invention is to provide a valve assembly for use in an aerosol spray can capable of spraying viscous materials or materials with large particulates without clogging or packing like traditional aerosol spray cans designed for spraying texture materials.

Another object of the present invention is to provide an inexpensive and economical means for matching surface texture of a repaired or patched surface area on a drywall panel, acoustic ceiling, or stucco-covered surface.

Another object of the present invention is to improve the appearance of patched or repaired areas on a textured surface by employing a spray-on hardenable texture material that covers the repaired or patched area and visually assumes the surface texture of the surrounding patched or repaired surface.

Another object of the present invention is to provide a hand-held dispensing unit containing a pressurized texture surface material for spray-on and direct application of the material in a liquid or semi-liquid form onto a repaired or patched area so that the surrounding patched or repaired surface will be visually and mechanically matched.

Another object of the present invention is to provide a valve assembly for use in an aerosol spray can capable of spraying highly-viscous materials, such as fire suppressant materials, adhesive and bonding materials, and culinary sauces, without clogging or packing like traditional aerosol spray cans when spraying these materials.

One embodiment of the valve assembly comprises a dip tube primarily disposed inside a container. A rod is disposed inside the dip tube so that it may move lengthwise within the dip tube. A sealing member is coupled to the bottom end of the rod, so as to form a tight-seal with the bottom opening of the dip tube when the rod is in an up position, and it exposes the bottom opening of the dip tube to the heavy and particulate material inside the container when the rod is in a down position. A bushing is also coupled to the top opening of the dip tube. Finally, an actuator is coupled to the top end of the rod and the bushing, allowing the user to depress on the actuator, thus lowering the rod to its down position and exposing the bottom opening of the dip tube to the material within the container, and allowing the heavy and/or particulate material to move up the dip tube and out of the container.

Another embodiment of the valve assembly comprises a dip tube primarily disposed inside the container. An interior tube is disposed inside the dip tube so that it may move lengthwise within the dip tube. There is at least one orifice at the bottom end of the interior tube. A top O-ring is coupled to the interior tube adjacent the at least one orifice to prevent any bypass of the heavy and particulate material into the dip tube, and a bottom O-ring is coupled to the bottom end of the interior tube to seal off the valve assembly when not actuated. The top opening of the dip tube may be coupled to a bushing. Finally, an actuator is coupled to the top end of the interior tube, allowing the user to depress on the actuator, thus lowering the interior tube to its down position and exposing the at least one orifice on the interior tube to the material inside the container and allowing the heavy and particulate material to flow up the interior tube and out of the container.

Yet another embodiment of the valve assembly comprises a dip tube primarily disposed inside the container. This dip tube may move lengthwise, and may extend beyond the top of the container. At least a portion of the dip tube rests within a sleeve located inside the container. A spring may engage both the sleeve and the dip tube, thereby having the dual effect of pushing the sleeve against the bottom of the container and the top of the dip tube out of the container.

There is at least one orifice on the dip tube that is brought into alignment with an orifice on the sleeve when the dip tube is lowered incident to actuation. There is also at least a first seal coupled to the sleeve adjacent to and below the at least one orifice on the dip tube to form a seal to prevent bypass of the sprayable material into the dip tube when the dip tube is not actuated. There may also be a bushing coupled to the dip tube and adjacent to the top opening. Finally, an actuator is coupled to the top end of the dip tube. This allows the user to depress on the actuator, thus lowering the dip tube to its down position and aligning the at least one orifice on the dip tube with the at least one orifice on the sleeve, thereby allowing the sprayable heavy and particulate material to flow up the dip tube and out of the container.

A further embodiment of the valve assembly comprises a dip tube having a predetermined length that is primarily disposed within the container. This dip tube may move lengthwise, and may extend beyond the top of the container. There is also a valve core that is at least partially disposed within the dip tube, with a spring engaging both the valve core and the dip tube. This spring may be a rubber cylinder or a metal spring. The spring pushes the dip tube up and partially out of the container, while pushing the valve core against the bottom of the container. There is at least one orifice on the valve core and at least one orifice on the dip tube that are brought into alignment when the dip tube is lowered. There is also at least one seal located adjacent to and below the orifice on the valve core that prevents sprayable material from entering the dip tube when it is an up position. There may also be a bushing coupled to the dip tube and adjacent to the top opening in the container. This bushing may be a diaphragm that is coupled to the top of the container and the dip tube. Finally, an actuator is coupled to the top end of the dip tube. This allows the user to depress on the actuator, thus lowering the dip tube to its down position and aligning the at least one orifice on the dip tube with the at least one orifice on the valve core, thereby allowing the sprayable heavy and particulate material to flow up the dip tube and out of the container.

The above embodiments, and others, may be designed to spray a binary compound. The binary compound can be packaged within one aerosol system, yet kept in two separate portions until combined by the user. Such a configuration is particularly beneficial in the case of a system in which a catalyst is used. In one configuration, the catalyst is stored in the cavity created within a tube that extends into the aerosol system. For example, the catalyst may be stored within the cavity created within the dip tube of one of the above embodiments of the present invention when the interior tube or rod is in an up position. The catalyst may be released to mix with the sprayable material by lowering the rod or interior tube, thereby opening either the bottom of the dip tube or an orifice. The mixing of the two substances may be achieved by providing a storage cap as well as a spray tip. The user may depress the storage cap to lower the rod or interior tube and shake the aerosol system to mix the catalyst with the rest of the sprayable material. Once the two substances have mixed, the user then may replace the storage cap with the spray tip and spray as desired.

Alternatively, the catalyst may be stored in a receptacle that is connected to the dip tube inside the container at an orifice on the dip tube. In this configuration, when the interior tube is lowered incident to spraying, the orifice on the receptacle comes into alignment with an orifice on the dip tube. The flow of the catalyst may be controlled by altering the size of the orifice so that an appropriate amount of catalyst is mixed an appropriate amount of sprayable material. This configuration permits the user to control the timing of the mixing of the catalyst with the sprayable material so that the aerosol system may be utilized over a longer period of time.

When a heavy or particulate material is dispensed from an aerosol can, the material frequently clogs the spray nozzle or other parts of the apparatus. One reason that this may occur is that, in such materials, the velocity of the fluid and particles is not static. If the diameter or area of the space through which the material is flowing is increased, the velocity of the fluid declines. At the same time, the heavier or denser portions of the material slow down and tend to sink. This results in a partial separation of the material. Conversely, if the diameter or area of the space through which the material flows is decreased, the velocity of the fluid increases. Since it takes additional time for the heavier or denser portions of the material to gain velocity, these portions may aggregate and block the flow of the material. Once the heavier or denser portion starts to aggregate, it can filter heavy or dense portions from the material. This can continue until the backlog of this portion stops the flow of the more liquid portion of the spray.

The present invention prevents clogging or packing of the valve assembly because the valve opening is at the bottom of the container, as opposed to being at the top, as in traditional aerosol spray cans. The placement of the value opening at the bottom of the container greatly reduces the clogging or packing of the valve by texture materials having large particulates, since the reduction in cross section occurs much earlier in the spraying system. Further, the diameter of the valve opening may be varied in diameter, depending on the material being sprayed. This improvement allows the efficient and low-cost spraying of heavy and more highly-textured materials, because there is no longer the problem of clogging or packing of the valve opening by the particulates suspended within the texture material. Additionally, the diameter and length of the dip tube may be varied to allow for cosmetic variation in the pattern of the material sprayed.

Other features and advantages of the invention will become apparent from the following detailed description, taken in conjunction with the accompanying drawings that illustrate, by way of example, various features and embodiments of the invention.

BRIEF DESCRIPTION OF THE DRAWINGS

FIG. 4 is a cross-sectional view of a valve assembly in accordance with an embodiment of the present invention.

DETAILED DESCRIPTION OF THE PREFERRED EMBODIMENTS

Figure 1:
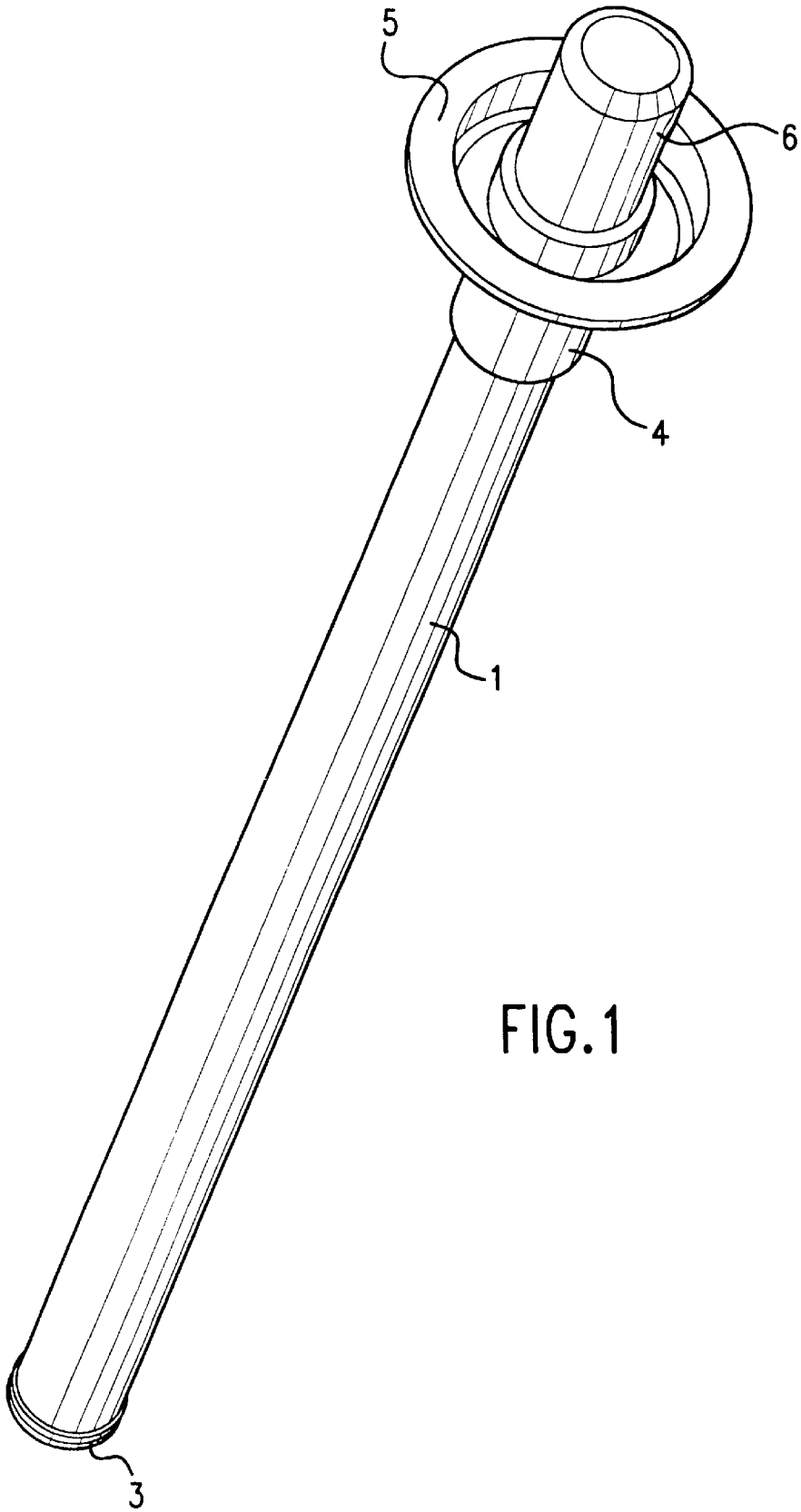
FIG. 1 is a perspective view of a valve assembly in accordance with an embodiment of the present invention.
Figure 3:
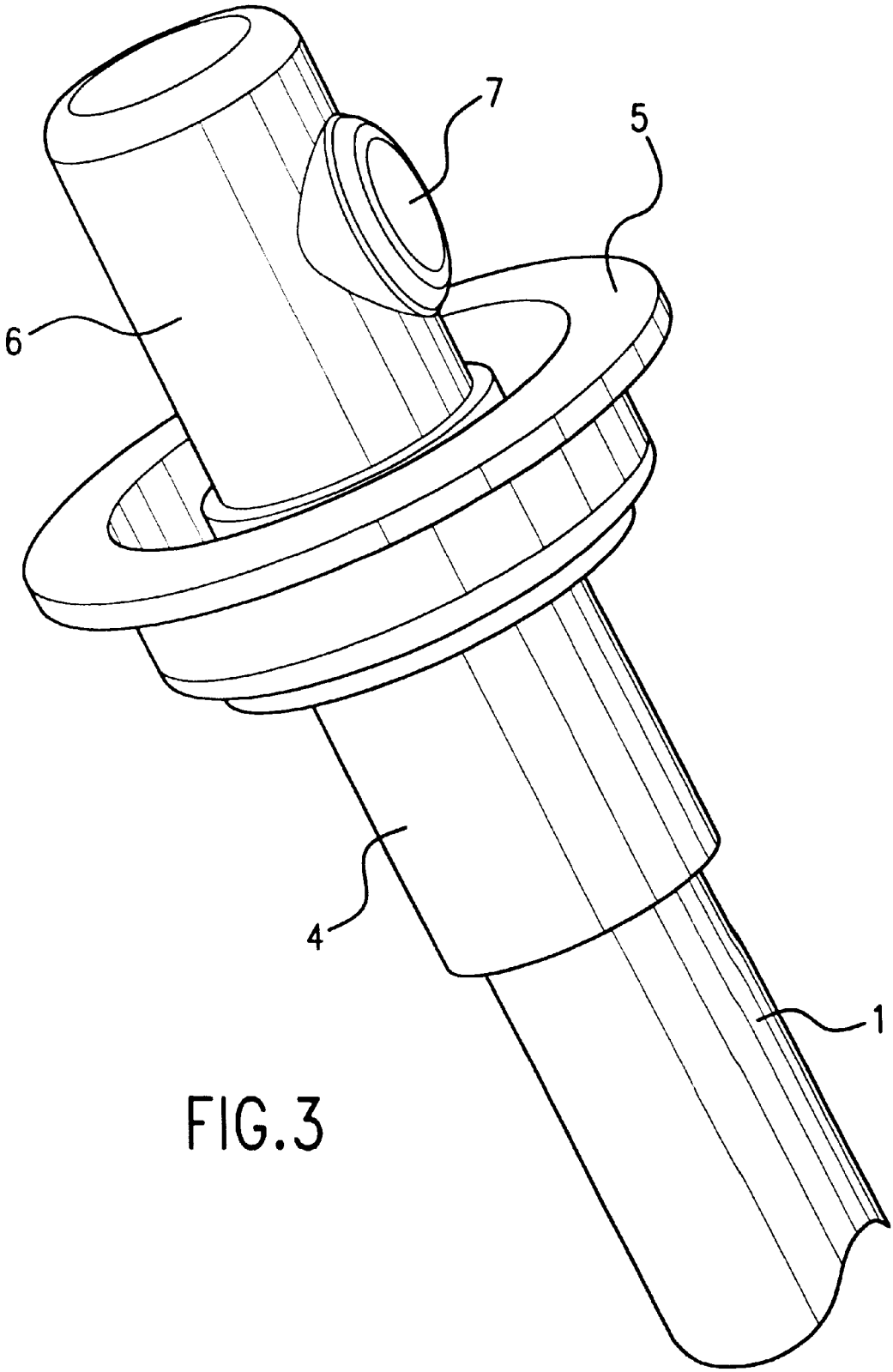
FIG. 3 is a perspective view of a valve assembly in accordance with an embodiment of the present invention.
Figure 5:
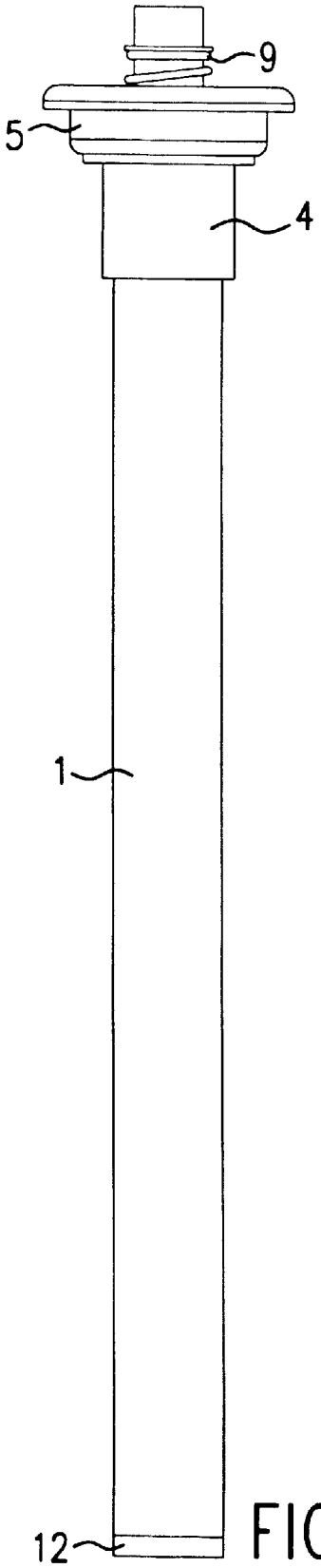
FIG. 5 is a perspective view of a valve assembly in a closed position in accordance with an embodiment of the present invention.
Figure 6:
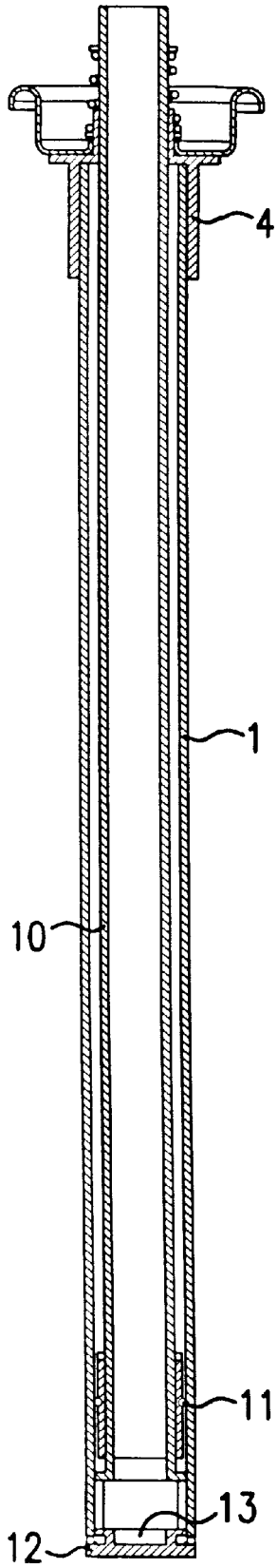
FIG. 6 is a cross-sectional view of a valve assembly in a closed position in accordance with an embodiment of the present invention.
Figure 7A:
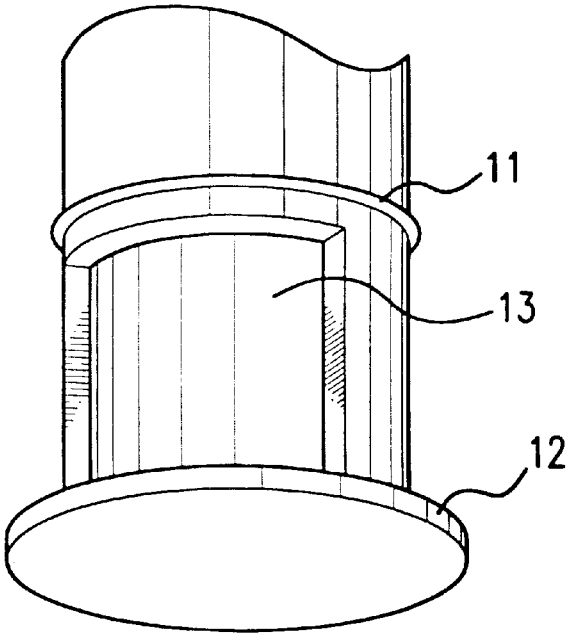
FIGS. 7(*a*) and 7(*b*) illustrate perspective views of a valve assembly in accordance with an embodiment of the present invention.
Figure 7B:
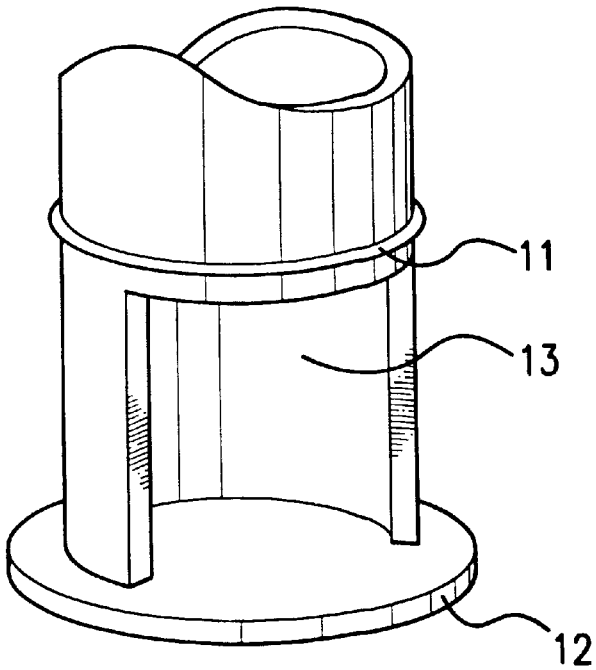
Figure 8:
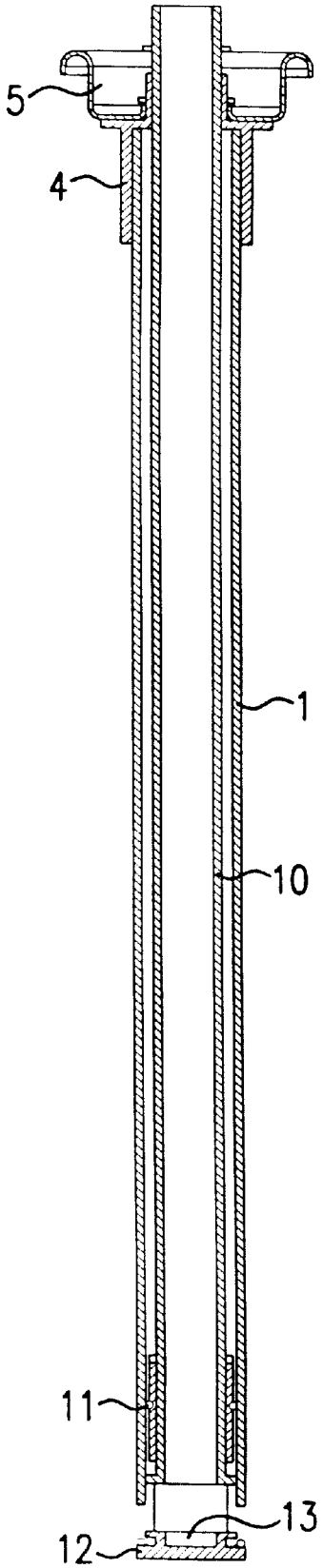
FIG. 8 is a cross-sectional view of a valve assembly in an opened position in accordance with an embodiment of the present invention.
Figure 9:
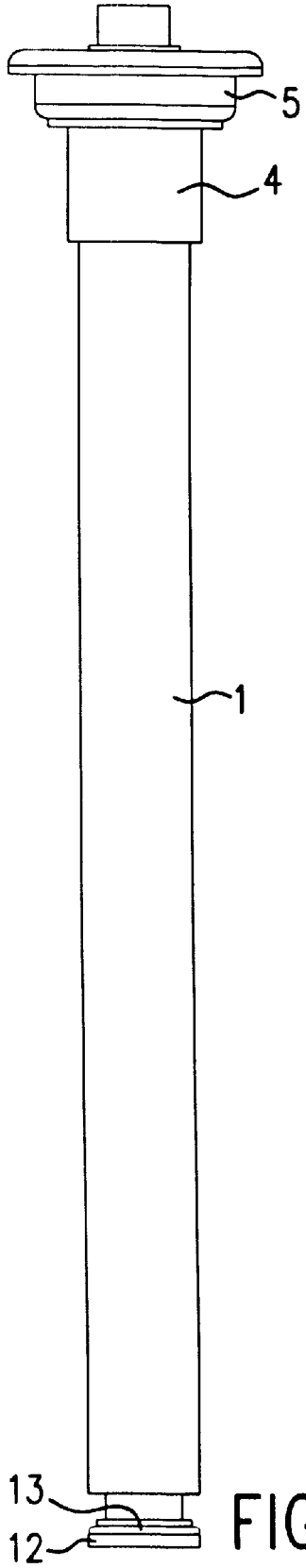
FIG. 9 is a perspective view of a valve assembly in an opened position in accordance with an embodiment of the present invention.

FIGS. 1 and 3 are perspective views of a valve assembly in accordance with an embodiment of the present invention. A dip tube 1 is coupled to a bushing 4, which may also be coupled to a cup 5. An actuator 6 is also coupled to the bushing 4.

Figure 2:
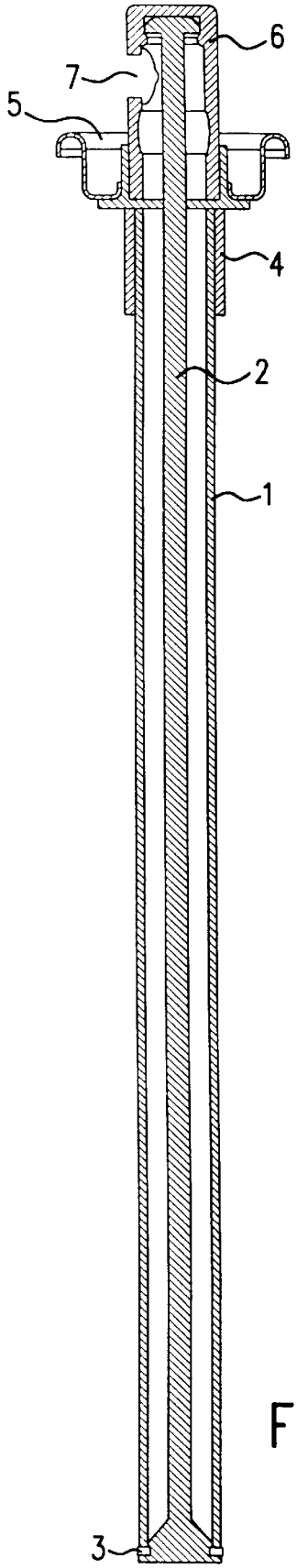
FIG. 2 is a cross-sectional view of a valve assembly in accordance with an embodiment of the present invention.

In FIGS. 2 and 4, an aperture on the actuator 6 forms a nozzle opening 7, in which a dispersing apparatus, such as a nozzle cap or a dispensing tube, may be attached or screwed. A rod 2 is primarily disposed inside the dip tube 1 in a way that allows the rod 2 to move within the dip tube 1 along its length. The actuator 6 is coupled to the top end of the rod 2, so that when the actuator 6 is depressed, the rod 2 moves downward within the dip tube 1. A sealing member 3 is coupled to the bottom end of the rod 2, so that when the rod 2 is in an up position, i.e., the actuator 6 is not depressed, the sealing member 3 forms a tight-seal with the bottom opening of the dip tube 1. However, when the rod 2 is in a down position, i.e., the actuator 6 is depressed, the sealing member 3 exposes the bottom opening of the dip tube 1 to the heavy and particulate material inside the container, and the propellant within the container will force the texture material through the bottom opening of the dip tube 1, up through the dip tube 1, and out of the container through the nozzle opening 7. The rod and the sealing member may be one unitary piece. The heavy and particulate material may be a variety of sprayable materials, including viscous materials or materials having large particulates, like that of stucco.

The cup 5 acts as a guide to limit how far down the actuator 6 may be depressed, and in turn how far down the rod 2 may travel within the dip tube 1. If the actuator 6 is depressed too far, the bottom end of the rod 2 may come in contact with the bottom surface of the container, which may result in damage to the container. The cup 5 is also adapted to fit securely over the top portion of an aerosol spray can and may also provide a surface for attaching the valve assembly to the aerosol spray can.

The placement of the valve opening at the bottom of the container, as opposed to near the top of the container, as described in the prior references, drastically reduces the clogging and packing of the valve opening as experienced by traditional aerosol spray cans when spraying texture materials containing large particulates, such as stucco. Further descriptions of an example of a heavy and particulate material is disclosed in pending patent application (Ser. No. 09/312,554) entitled, "Hardenable Texture Material in Aerosol Form," incorporated herein by reference. In addition to being capable of spraying stucco-like materials, the valve assembly is also particularly useful in spraying other types of materials having large particulates or high viscosities, including fire suppressant materials. These materials having large particulates or high viscosities may be dispensed directly from the valve system of an aerosol dispensing container. The aerosol dispensing container is preferably a size that allows it to be hand held and may be operated with one hand.

Ideally, the actuator 6 is made out of an elastic material, such as rubber, so as to allow the retention of the rod 2 in the up position when the actuator 6 is not depressed. The actuator 6 may also be made of a non-elastic material, but there may be a spring member coupled to the bushing 4 and engaging the actuator 6 so as to spring-load the actuator 6. The sealing member 3 should be made of a material, such as rubber, that will allow the sealing member 3 to form a tight-seal with the bottom opening of the dip tube 1 so as to prevent any entry of the texture material and the aerosol carrier into the dip tube 1 when the rod 2 is in the up position, i.e., when the actuator 6 is not being depressed.

FIGS. 5 to 9 show another embodiment of the present invention. A dip tube 1 is coupled to a bushing 4, which may also be coupled to a cup 5. A spring member 9 may be coupled to the bushing 4 to spring-load the actuator 6 engaging the spring member 9 on the bushing 4.

An interior tube 10 with a top end and a bottom end is disposed inside the dip tube 1 in a way that allows the interior tube 10 to move within the dip tube 1 along its length. The actuator 6 is coupled to the top end of the interior tube 10, so that when the actuator 6 is depressed, the interior tube 10 moves downward within the dip tube 1. There is at least one orifice 13 at the bottom end of the interior tube 10 so as to allow the heavy and particulate material from inside the container to flow up through the interior tube 10 and out of the nozzle opening. A top O-ring 11 is coupled to the interior tube 10 adjacent to and just above the at least one orifice 13 so as to form a seal to prevent any bypass of the heavy and particulate material from the container into the dip tube 1 when the interior tube 10 is in a down position. A bottom O-ring 12 is coupled to the bottom end of the interior tube 10 so as to seal off and close the valve assembly when the interior tube 10 is in an up position.

As described above, the cup 5 may act as a guide so as to limit how far down the actuator 6 may be depressed, as well as provide a surface for attaching the valve assembly to the container.

Figure 10:
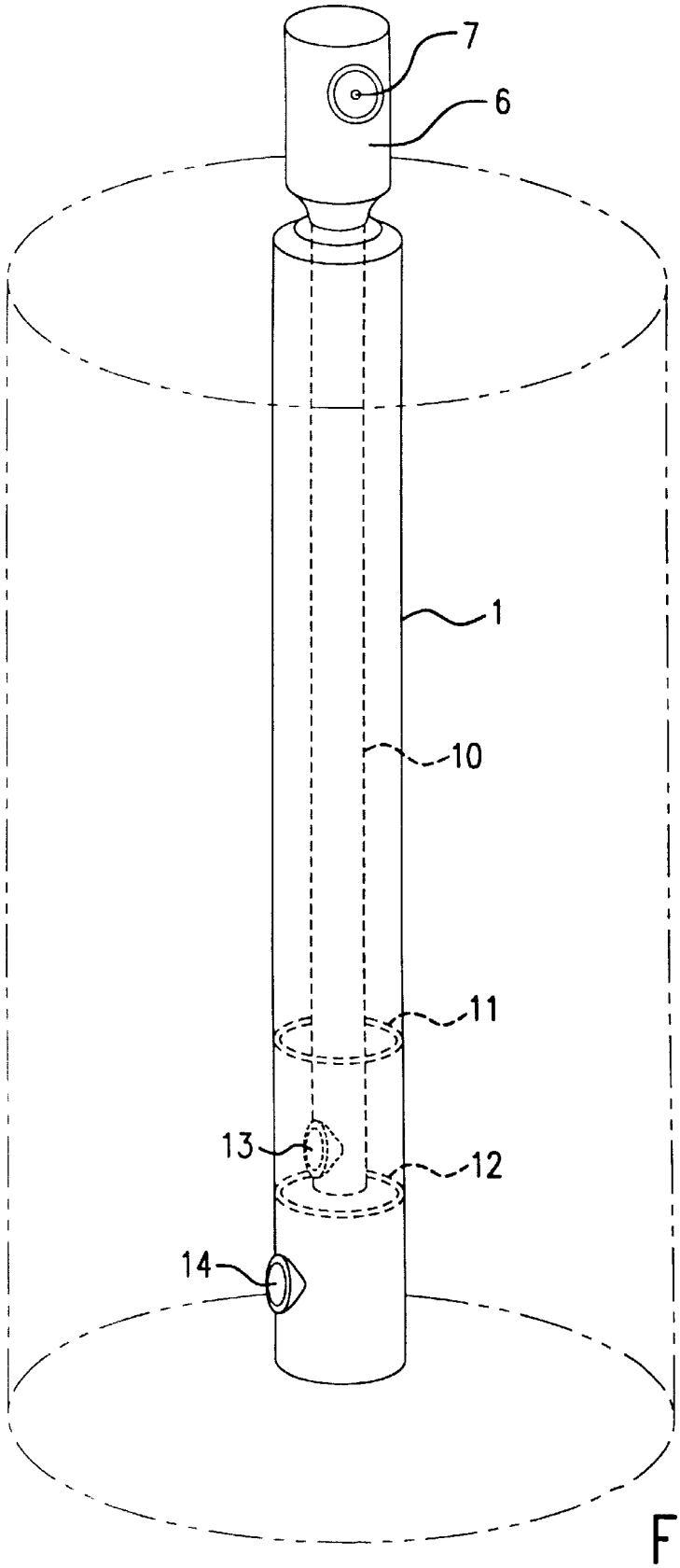
FIG. 10 is a cross-sectional view of a valve assembly in accordance with an embodiment of the present invention.

FIG. 10 shows yet another embodiment of the present invention. There is at least one exterior orifice 14 on the dip tube 1 that is adapted to be in flow alignment with the at least one orifice 13 of the interior tube 10. Therefore, when the actuator 6 is depressed and the interior tube 10 is lowered to its open position, the at least one orifice 13 of the interior tube 10 aligns with the at least one orifice 14 on the dip tube 1 so that the material inside the container may flow through the exterior orifice 14 and into the at least one orifice 13 of the interior tube 10 and up through the interior tube 10 and out of the container through the nozzle opening 7. Similarly, there is a top O-ring 11 and a bottom O-ring 12, as described above, for sealing off the dip tube 1 to prevent any bypass of the heavy and particulate material from the container and for closing the valve assembly.

Figure 11:
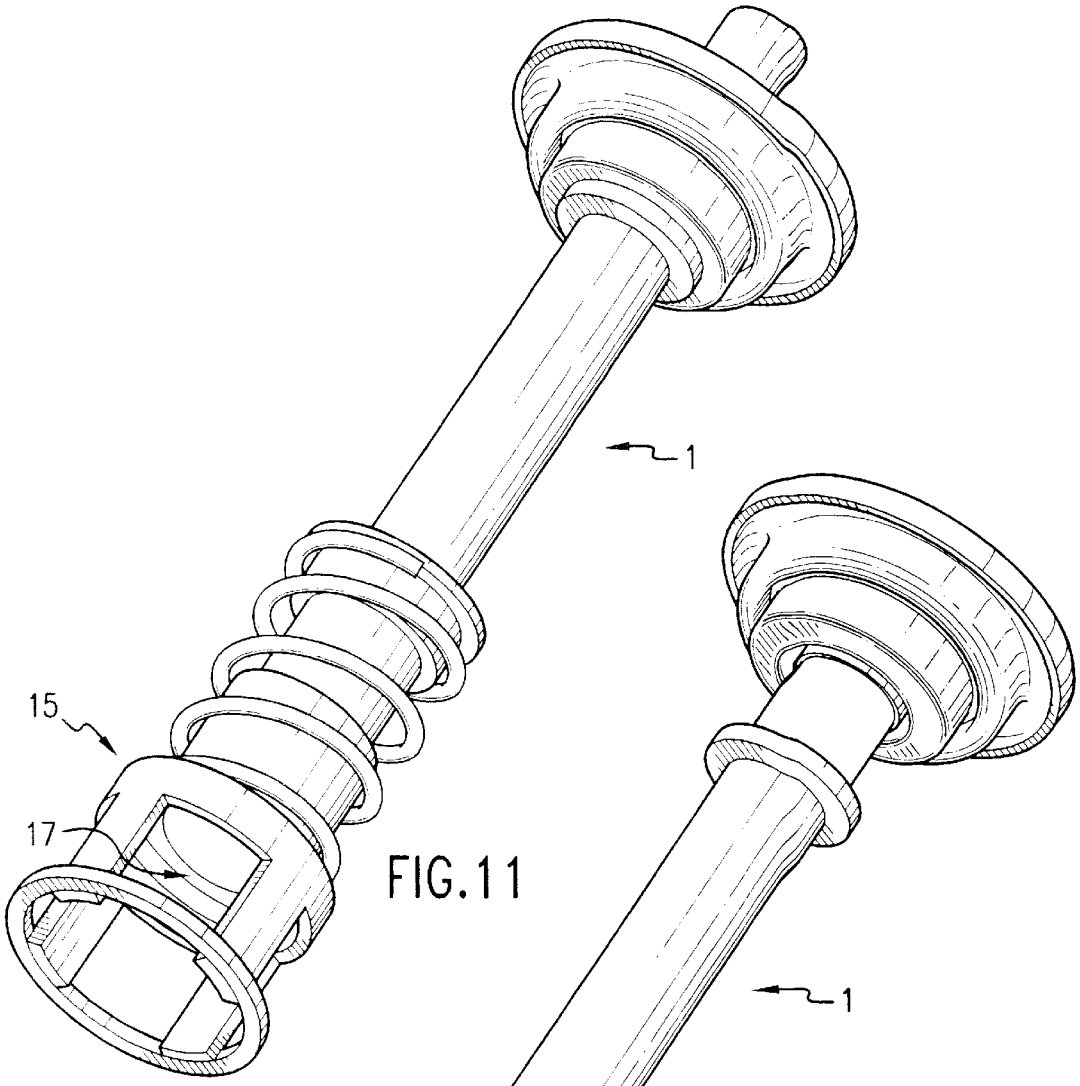
FIG. 11 is a perspective view of a valve assembly in a closed position in accordance with an embodiment of the present invention.
Figure 12:
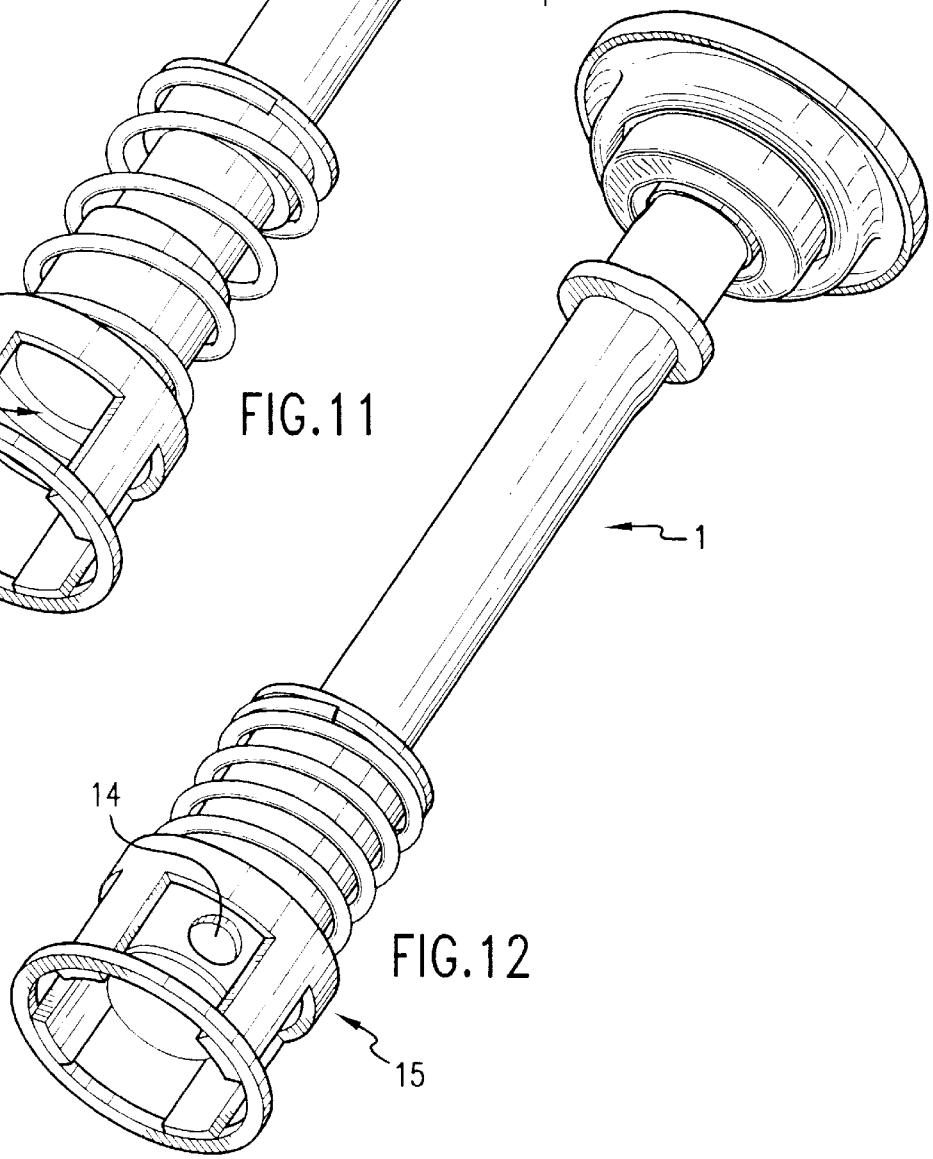
FIG. 12 is a perspective view of a valve assembly in an open position in accordance with an embodiment of the present invention.
Figure 13:
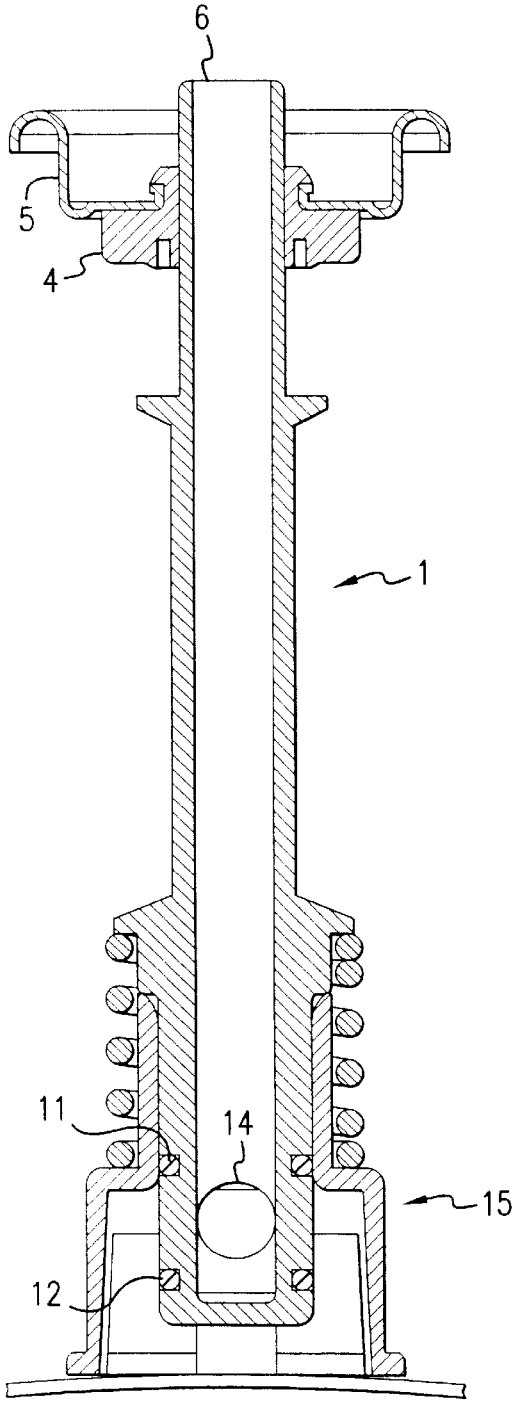
FIG. 13 is a cross-sectional view of a valve assembly in an open position accordance with an embodiment of the present invention.
Figure 14:
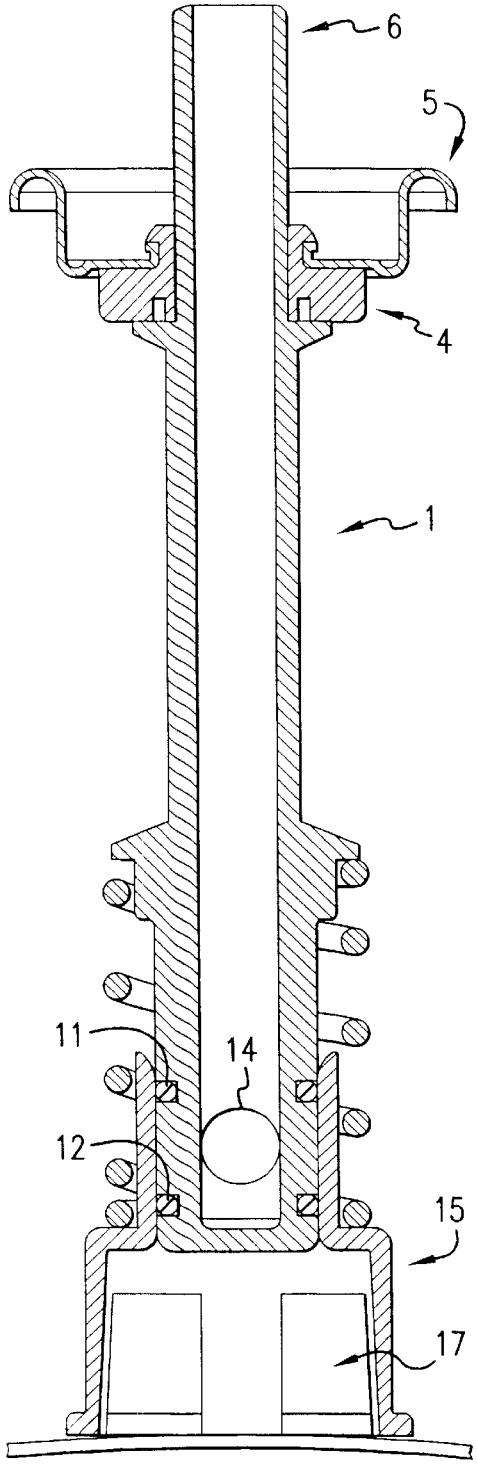
FIG. 14 is a cross-sectional view of a valve assembly in a closed position accordance with an embodiment of the present invention.

FIGS. 11–14 depict another embodiment of the present invention. FIGS. 11 and 14 depict the assembly with the dip tube 1 in an up position. FIGS. 12 and 13 depict the assembly with the dip tube 1 in a down position. There is at least one exterior orifice 14 on dip tube 1 that is adapted to be in flow alignment with the at least one orifice 17 of the sleeve 15. Therefore, when the actuator (not shown) is depressed, and dip tube 1 is lowered to its open position, the at least one orifice 13 of the dip tube aligns with the at least one orifice 17 on the sleeve 15 so that the material inside the container may flow through the orifice 14 of the dip tube 1 and up through the dip tube 1 and out of the container through the nozzle (not shown). Similarly, there is a top seal 11 and a bottom seal 12, as described above, for sealing off the dip tube 1 to prevent any bypass of the heavy and particulate material from the container and for closing the valve assembly. These seals may be O-rings.

Figure 15:
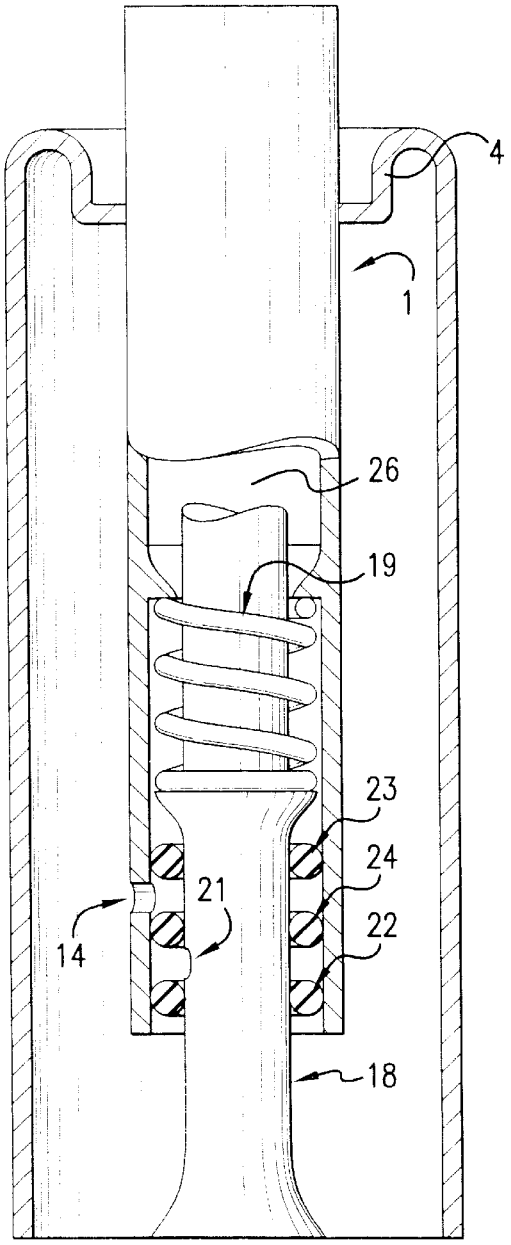
FIG. 15 is a cross-sectional view of a valve assembly in a closed position accordance with an embodiment of the present invention.
Figure 16:
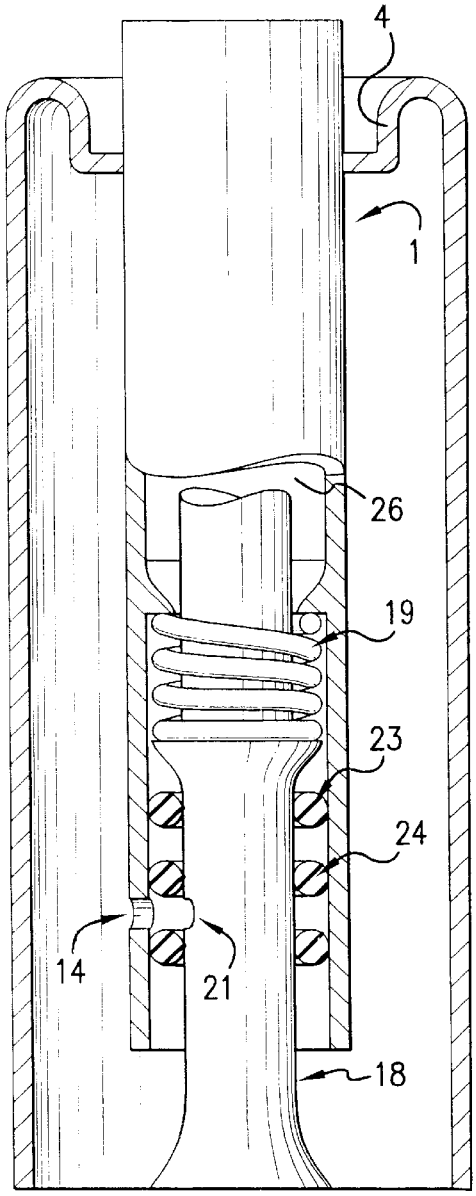
FIG. 16 is a cross-sectional view of a valve assembly in an open position accordance with an embodiment of the present invention.

FIGS. 15 and 16 depict another embodiment of the present invention. There is at least one exterior orifice 14 on dip tube 1 that is adapted to be brought into flow alignment with the at least one orifice 21 on valve core 18 when dip tube 1 is lowered. A spring 19 may engage both the dip tube 1 and the valve core 18 such that the dip tube 1 is pushed upwards, out of the container, and the valve core 18 is pushed downwards, towards the bottom of the container. Spring 19 may, for example, be a rubber cylinder or a metal spring. There is at least one seal 22 located adjacent to and below orifice 21 on valve core 18 that prevents sprayable material and propellant from entering the dip tube and the valve core when it is an up position. There is at least a second seal 23 on the interior of dip tube 1 located adjacent to and above orifice 14 that prevents sprayable material from entering dip tube 1 when it is an up position. Further, there is at least a third seal 24 on the interior of dip tube 1 located adjacent to and below orifice 14 that prevents sprayable material from entering dip tube 1 and valve core 18 when dip tube 1 is in an up position. There may also be a bushing 4 coupled to dip tube 1 and adjacent to the top of the container. This bushing 4 may be a diaphragm that is coupled to the top of the container and dip tube 1. A cup may also be included, as discussed above. Finally, an actuator (not shown) may be coupled to the top end of the dip tube.

FIGS. 15–16 also depict another feature of the present invention that may be utilized in conjunction with embodiments of the present invention, such as described above: the storage of a binary system within one system such that the two portions are kept separate until caused to combine by the user. Such a configuration is particularly beneficial in the case of a system requiring a catalyst. A catalyst may be stored within the cavity 26 located within the dip tube 1 when the interior rod 2 is in an up position. Alternatively, the catalyst may be stored within the cavity 26 located within interior tube 10. When the interior rod 2 or interior tube 10 is lowered by the user, the catalyst may then mix with the sprayable heavy and particulate material. The user may shake the can while the interior rod 2 or interior tube 10 is lowered to facilitate mixing the catalyst 25 with the heavy and particulate material. This may be accomplished by providing both a cap and a spray nozzle. The user may first depress the cap to lower the interior rod or interior tube to mix the catalyst with the sprayable material. Secondly, the user may replace the cap with the spray nozzle and spray the material as desired.

Figure 17:
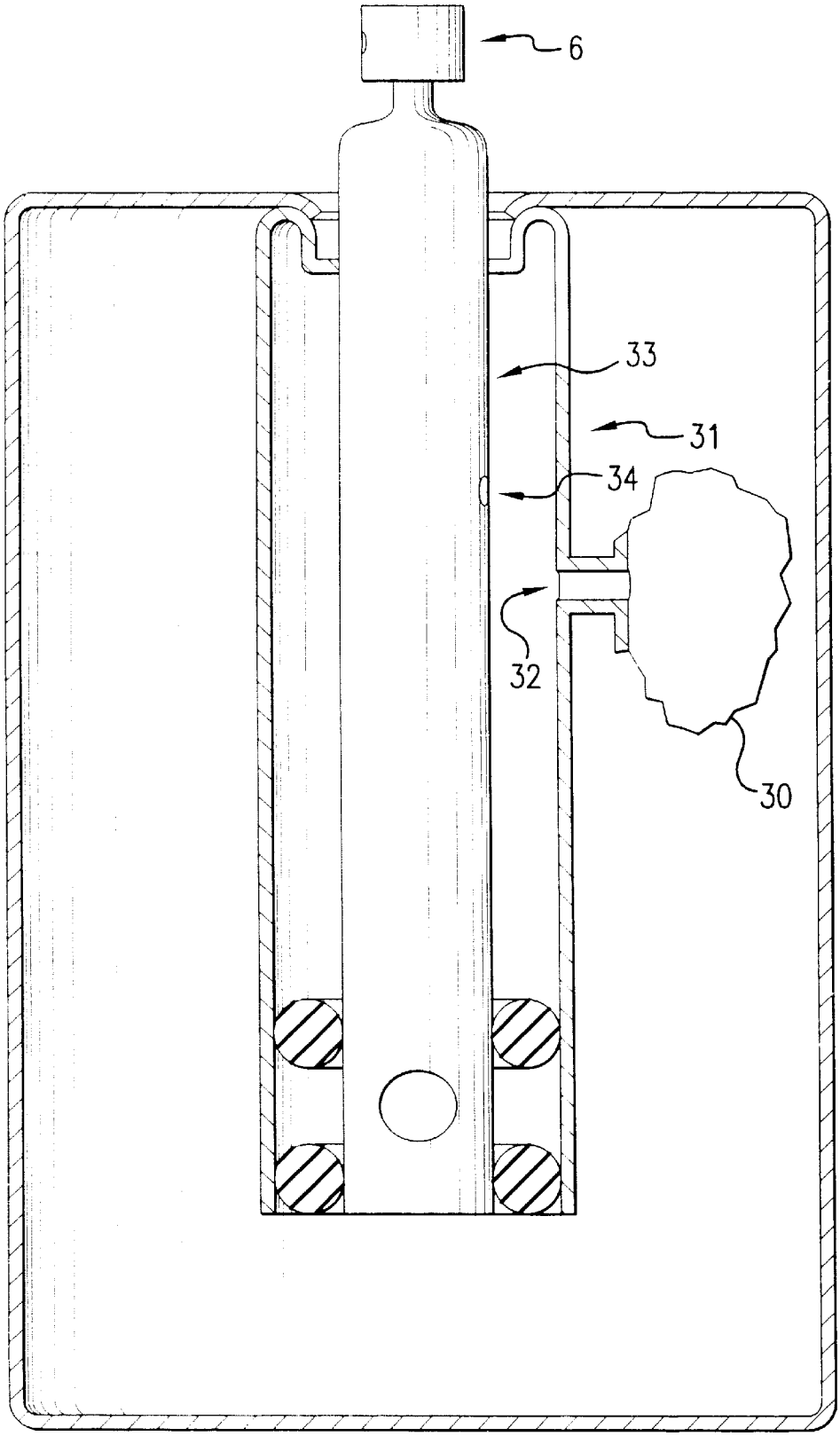
FIG. 17 is a cross-sectional view of a valve assembly highlighting a catalyst sack as in a feature of the present invention.

As shown in FIG. 17, the catalyst may also be stored in a pouch 30 that is connected to the dip tube 31 inside the container at an orifice 32 on the dip tube 31. In this configuration, when the interior tube 33 is lowered incident to spraying, an orifice 32 on the dip tube 31 comes into alignment with another orifice 34 on the interior tube 33, thus dispensing a portion of the catalyst at the same time as a portion of the sprayable heavy and particulate material is dispensed. The amount of catalyst that is dispensed with the sprayable heavy and particulate material may be varied by changing the size of one or both of the orifices 32, 34.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein.

What is claimed is:

1. A valve assembly for use in an aerosol system, wherein the valve assembly comprises:

a dip tube having a top opening and a predetermined length and diameter, wherein the dip tube is adapted to move in a lengthwise direction;

a sleeve, wherein the dip tube is at least partially disposed within the sleeve, said sleeve having at least one orifice;

at least one spring that engages both the sleeve and the dip tube, wherein said spring, sleeve and dip tube combination is selected to be of sufficient length to extend from a top of an aerosol container to engage a bottom of the aerosol container; and at least one orifice on the dip tube adapted to be in flow alignment with the at least one orifice on the sleeve when the dip tube is in a down position, thereby permitting a sprayable material to flow through the at least one orifice on the sleeve and the at least one orifice on the dip tube, and into the dip tube.

2. The valve assembly as in claim 1, wherein the diameter of the dip tube is selected based on a material being sprayed.

3. The valve assembly as in claim 1, wherein the spring is selected from the group consisting of a rubber cylinder and a metal coil.

4. The valve assembly as in claim 1, further including at least one seal to prevent the flow of sprayable material into the dip tube when the dip tube is in an upwards position.

5. The valve assembly as in claim 4, wherein the seal is located below the at least one orifice on the dip tube and above the at least one orifice on the sleeve when the dip tube is in an up position.

6. The valve assembly as in claim 1, further including a first fraction of a sprayable material that is stored within the dip tube so that the first fraction of sprayable material mixes with a second fraction of sprayable material when an opening on the dip tube is brought into flowable alignment with an opening on the sleeve when the dip tube is in a down position.

7. The valve assembly as in claim 1, further including a first fraction of a sprayable material that is stored within a storage member that is attached in flowable alignment to an opening on the sleeve at an opening on the storage member.

8. The valve assembly as in claim 7, wherein such first fraction is mixed with a second fraction of the sprayable material when the opening on the storage member and the opening on the sleeve are brought into flowable alignment with an opening on the dip tube when the dip tube is in a down position.

9. The valve assembly as in claim 7, wherein the storage member is a sack.

10. The valve assembly as in claim 9, wherein the sack is composed of material selected from the group consisting of: plastic and rubber.

11. A valve assembly for use in an aerosol system, wherein the valve assembly comprises:

a dip tube having a predetermined length and diameter, with a top opening, wherein the dip tube is adapted to move in a lengthwise direction;

a valve core with a top end and a bottom end, wherein the valve core is at least partially disposed within the dip tube;

at least one spring that engages both the dip tube and the valve core, wherein the spring, dip tube and valve core combination is selected to be of sufficient length to extend from a top of an aerosol container to engage a bottom of the container;

at least one orifice on the dip tube; and at least one orifice in the valve core adapted to be in flow alignment with the at least one orifice on the dip tube when the dip tube is in a down position, thereby permitting the flow of sprayable material through the at least one orifice on the dip tube and the at least one orifice on the valve core, and into the dip tube.

12. The valve assembly as in claim 11, wherein the spring is selected from the group consisting of a rubber cylinder and a metal spring.

13. The valve assembly as in claim 11, further including at least one seal to prevent the bypass of sprayable material into the dip tube when the dip tube is in an up position.

14. The valve assembly as in claim 11, further including a first fraction of a sprayable material that is stored within the dip tube so that the first fraction of sprayable material mixes with a second fraction of sprayable material when an orifice on the dip tube is brought into flowable alignment with an orifice on the valve core by the lowering of the dip tube.

15. The valve assembly as in claim 11, further including a first fraction of a sprayable material that is stored within a storage member, wherein the storage member is attached to and in flowable alignment with an opening on the dip tube at an opening on the storage member.

16. The valve assembly as in claim 15, wherein the first fraction is mixed with a second fraction of the sprayable material when the opening on the dip tube and the opening on the storage member are brought into flowable alignment with an opening on the valve core when the dip tube is in a down position.

17. The valve assembly as in claim 15, wherein the storage member is a sack.

18. The valve assembly as in claim 17, wherein the sack is composed of material selected from the group consisting of: plastic and rubber.

19. A valve assembly for use in an aerosol system wherein the valve assembly comprises:

a dip tube having a predetermined length and diameter, with a top opening and a bottom opening;

a rod with a top end and a bottom end, wherein the rod is primarily disposed within the dip tube and is adapted to move lengthwise within the dip tube;

a sealing member coupled to the bottom end of the rod, forming a tight-seal with the bottom opening of the dip tube so that sprayable material enters the dip tube when the rod is in a down position.

20. The valve assembly according to claim 19, wherein the sealing member and the rod are comprised of a unitary member.

21. The valve assembly according to claim 20, further including a first fraction of a sprayable material that is stored within the dip tube so that the first fraction mixes with a second fraction of the sprayable material when the rod is lowered.

* * * * *